US009562738B2

(12) United States Patent
Hanson

(10) Patent No.: US 9,562,738 B2
(45) Date of Patent: Feb. 7, 2017

(54) SPLIT COMPRESSION PISTON

(71) Applicant: Crosman Corporation, Bloomfield, NY (US)

(72) Inventor: Jeffrey Hanson, West Henrietta, NY (US)

(73) Assignee: Crosman Corporation, Bloomfield, NY (US)

( * ) Notice: Subject to any disclaimer, the term of this patent is extended or adjusted under 35 U.S.C. 154(b) by 462 days.

(21) Appl. No.: 14/148,409

(22) Filed: Jan. 6, 2014

(65) Prior Publication Data

US 2014/0331855 A1 Nov. 13, 2014

Related U.S. Application Data

(60) Provisional application No. 61/822,177, filed on May 10, 2013.

(51) Int. Cl.
*F41B 11/00* (2013.01)
*F41B 11/642* (2013.01)

(52) U.S. Cl.
CPC ..... *F41B 11/642* (2013.01)

(58) Field of Classification Search
CPC ..... F41B 11/60; F41B 11/64; F41B 11/642; F41B 11/643; F41B 11/644; F41B 11/645; F41B 11/66; F16J 1/005; F41A 25/22
USPC ..... 92/109, 114, 134, 192, 193, 194, 203,92/204, 205, 216, 240, 241, 244, 248, 250, 251
See application file for complete search history.

(56) References Cited

U.S. PATENT DOCUMENTS 1,543,505 A * 6/1925 Middleton ..... F16J 15/3208 222/390
4,572,152 A 2/1986 Olofsson et al.
4,771,758 A * 9/1988 Taylor ..... F41B 11/73 124/68
5,570,676 A * 11/1996 Gore ..... F41B 11/642 124/56
6,035,740 A * 3/2000 Budaker ..... B62D 1/185 267/118
7,854,221 B1 12/2010 Gore
(Continued)

FOREIGN PATENT DOCUMENTS

GB 571163 * 9/1943 ..... F41B 11/00
GB 2051321 * 1/1981 ..... F41B 11/00

OTHER PUBLICATIONS

BSA Guns: Meteor Air Rifle Owner's Instruction Manual website (11 pages)—Issue 16-6694 www.bsaguns.com.
(Continued)

*Primary Examiner* — Michael Leslie
*Assistant Examiner* — Dustin T Nguyen
(74) *Attorney, Agent, or Firm* — Brian B. Shaw, Esq.; Harter Secrest & Emery LLP

(57) ABSTRACT

In a spring piston airgun, a compression piston is provided for longitudinal translation within a compression tube in response to a motive force. The compression piston includes a main piston body and a piston head, wherein the piston body and piston head are coupled for partial independent translation along a longitudinal axis. A resilient compressible bushing is longitudinally intermediate a portion of the piston body and the piston head, such that upon a deceleration of the piston head, the piston body is not immediately acted upon by the deceleration, rather the bushing absorbs a portion of the deceleration and radially expands to contact the compression tube.

15 Claims, 12 Drawing Sheets

(56) References Cited

U.S. PATENT DOCUMENTS

| | | | | |
|---|---|---|---|---|
| 8,156,929 | B1 | 4/2012 | Gore | |
| 8,397,704 | B1 | 3/2013 | Gore | |
| 2010/0059033 | A1 | 3/2010 | Gore | |
| 2010/0074780 | A1* | 3/2010 | Riley | F04B 53/143 417/437 |

OTHER PUBLICATIONS

BSA Meteor: Part 3 | Air gun blog—Pyramyd Air Report website (17 pages)—Jan. 21, 2014 http://www.pyramydair.com/blog/2013/10/bsa-meteor-part-3/.

BSA Meteor Piston—Bing Images (10 pages)—Jan. 21, 2014 http://www.bing.com/...iston&FORM=IQFRBA &id=F9B376B9613D0C3474D1B16E9E98842BA38B5AC5 . . . .

Mk4 Meteor BSA—Airgun spares | Chambers Gunmakers website (4 pages) Jan. 21, 2014 https://www.gunspares.co.uk/products/24701/Mk4.

PCT International Preliminary Report on Patentability in corresponding International Application No. PCT/US2014/036575 Mar. 15, 2016.

* cited by examiner

SPLIT COMPRESSION PISTON

CROSS-REFERENCE TO RELATED APPLICATIONS

Applicant claims the benefit of previously filed provisional patent application 61/822,177 filed May 10, 2013, the disclosure of which is hereby expressly incorporated by reference.

BACKGROUND OF THE INVENTION

The present disclosure is directed to airguns and particularly to spring piston airguns and more particularly to a compression piston for a spring piston airgun.

BRIEF SUMMARY OF THE INVENTION

In one configuration, the present disclosure is directed to an apparatus having a barrel, a compression tube having transfer port fluidly connected to the barrel, a compression piston at partially disposed within the compression tube and moveable within the compression tube between a first position and a second position, the compression piston having piston body and a piston head, a seal connected to the piston head and forming a sealed interface with an inside surface of the compression tube and a radially expandable bushing connected to the piston body, the bushing radially expanding in response to a longitudinal, such as a longitudinally compressive, force on the bushing, the radial expansion sufficient to contact the bushing with an inside surface of the compression tube and decelerate the piston body, such as relative to the compression tube.

In a further configuration, the compression piston includes a plurality of tail guides extending radially from the compression piston, the plurality of tail guides contacting the inside surface of the compression tube. It is understood the plurality of tail guides locate a portion of the compression piston relative to an inner surface of a compression tube.

A spring can be connected to the compression piston to move the compression piston from a first position in the compression tube to a second position in the compression tube. The spring can be a metal coil spring, a pneumatic or a gas spring.

Alternatively, the apparatus includes a compression piston having a main piston body, a piston head moveably connected to the piston body to be longitudinally displaceable relative to the piston body, the piston head including a seal and a radially expandable bushing contacting the piston head and the main piston body, the bushing radially expanding in response to relative longitudinal movement of the piston body towards the piston head.

The compression piston can be sized to be slideably received within a compression tube. It is further contemplated that a plurality of tail guides can radially project from the compression piston to locate the compression piston concentric with the compression tube. Specifically, the plurality of radially projecting tail guides locate a portion of the compression piston relative to the inner surface of a compression tube. The compression piston can also include a seal selected to provide a sealing interface with the compression tube.

A method is disclosed which includes using a spring to urge a compression piston to move within a compression tube towards a barrel end of the compression tube, the compression piston having a piston head and a piston body, the piston head being longitudinally displaceable relative to the piston body; and radially expanding a bushing intermediate the piston head and the piston body a sufficient radius to decelerate at least a portion of the compression piston relative to the compression tube.

It is understood the spring can be a coil spring or a gas spring. In the gas spring configuration, the gas spring includes a gas spring body defining a sealed interior chamber containing a compressed gas and a gas spring piston extending into and moveable relative to the sealed interior chamber, the interior chamber retaining the compressed gas when the gas spring piston moves.

A further method is provided of mounting a spring in a spring piston airgun to urge a compression piston to move within a compression tube towards a barrel end of the compression tube, the compression piston having a piston head and a piston body, the piston head being longitudinally displaceable relative to the piston body; and locating a radially expandable bushing intermediate the piston head and the piston body, the radially expandable bushing expanding in response to longitudinal displacement of the piston head relative to the piston body a sufficient radius to decelerate at least a portion of the compression piston relative to the compression tube.

The method can include using a coil spring or a gas spring as the spring. The gas spring can include a gas spring body defining a sealed interior chamber containing a compressed gas and a gas spring piston extending into and moveable relative to the sealed interior chamber, the interior chamber retaining the compressed gas when the gas spring piston moves.

Alternatively, an apparatus is provided having a barrel, a compression tube having transfer port fluidly connected to the barrel, a compression piston at partially disposed within the compression tube and moveable between a first position and a second position, a spring contacting the compression piston to selectively move the compression piston between the first position and the second position and a plurality of tail guides extending radially from the compression piston, the plurality of tail guides contacting an inside surface of the compression tube.

The tail guides can be formed of a different material than the compression tube and the compression piston. The tail guides can be located at a variety of circumferential locations on the compression piston.

Thus, a compression piston is provided for an airgun having a compression tube slideably receiving the compression piston and a spring selectively moving the compression piston relative to the compression tube, the compression piston comprising: a plurality of radially projecting tail guide locating a portion of the compression piston relative to an inner surface of the compression tube. It is understood, the gas spring can contact the compression piston.

BRIEF DESCRIPTION OF THE SEVERAL VIEWS OF THE DRAWINGS

The drawings provided in the present disclosure are provided solely to better illustrate particular embodiments of the present invention, and specifically do not provide an exhaustive or limiting set of embodiments of the present invention.

FIG. 11 is a side view cross section of the compression piston of

FIG. 10.

DETAILED DESCRIPTION OF THE INVENTION

The present system can be used in a variety of configurations to reduce deceleration induced vibration during firing of an airgun. In one configuration, the present system is used in an airgun to selectively provide compressed air to propel a bullet or projectile, and in a more specific configuration, the system is employed in a spring piston airgun 10.

For purposes of description of the airgun configurations, the term front or forward means towards the muzzle and the terms rear or rearward mean towards the butt end (or operator). The term longitudinal or longitudinal axis is used to describe a direction along the barrel, parallel to the barrel or along the longer dimension of the respective component.

Figure 1:
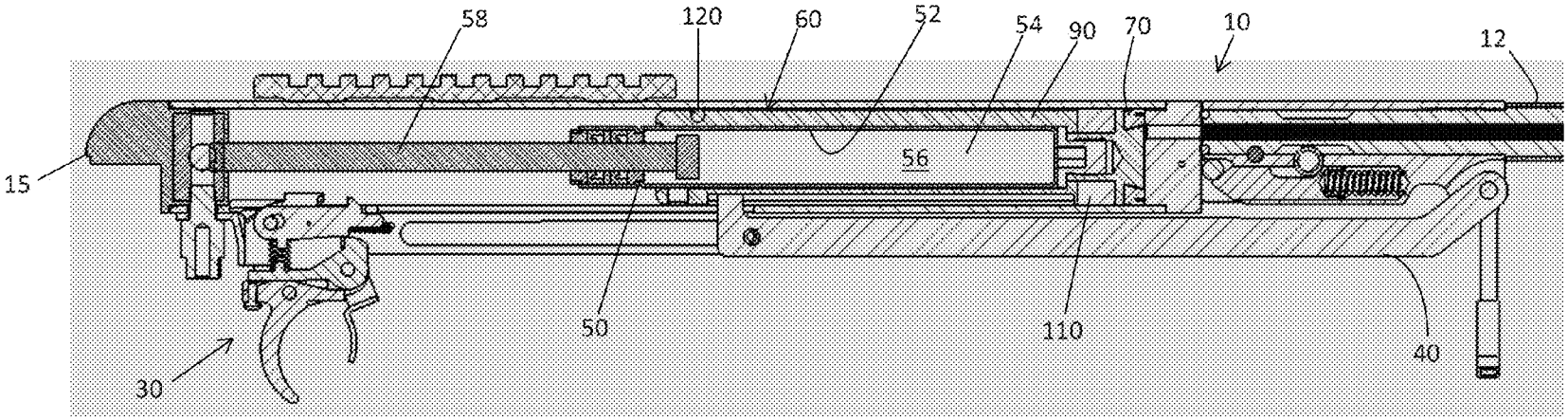
FIG. 1 is a partial side elevational view in cross section showing an airgun with a configuration of the present compression piston in a fired position.
Figure 2:
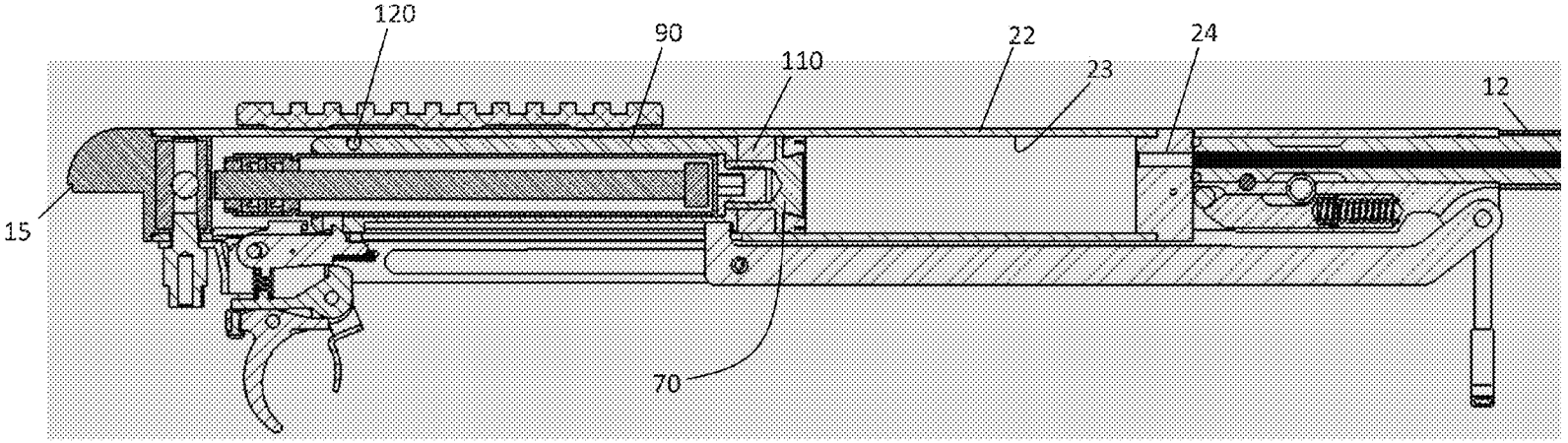
FIG. 2 is a partial side elevational view in cross section showing an airgun with a configuration of the present compression piston in a cocked position.
Figure 3:
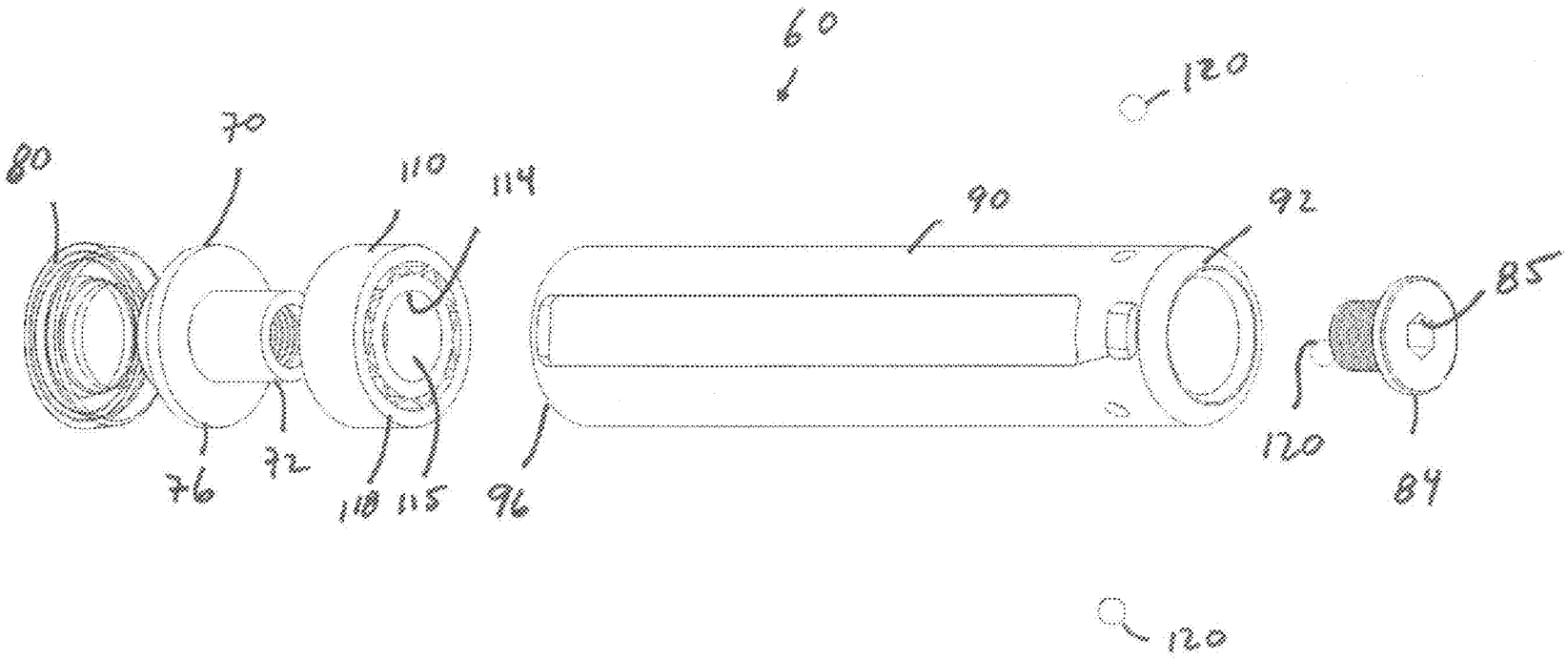
FIG. 3 is an exploded perspective view of one configuration of the present compression piston.
Figure 4:
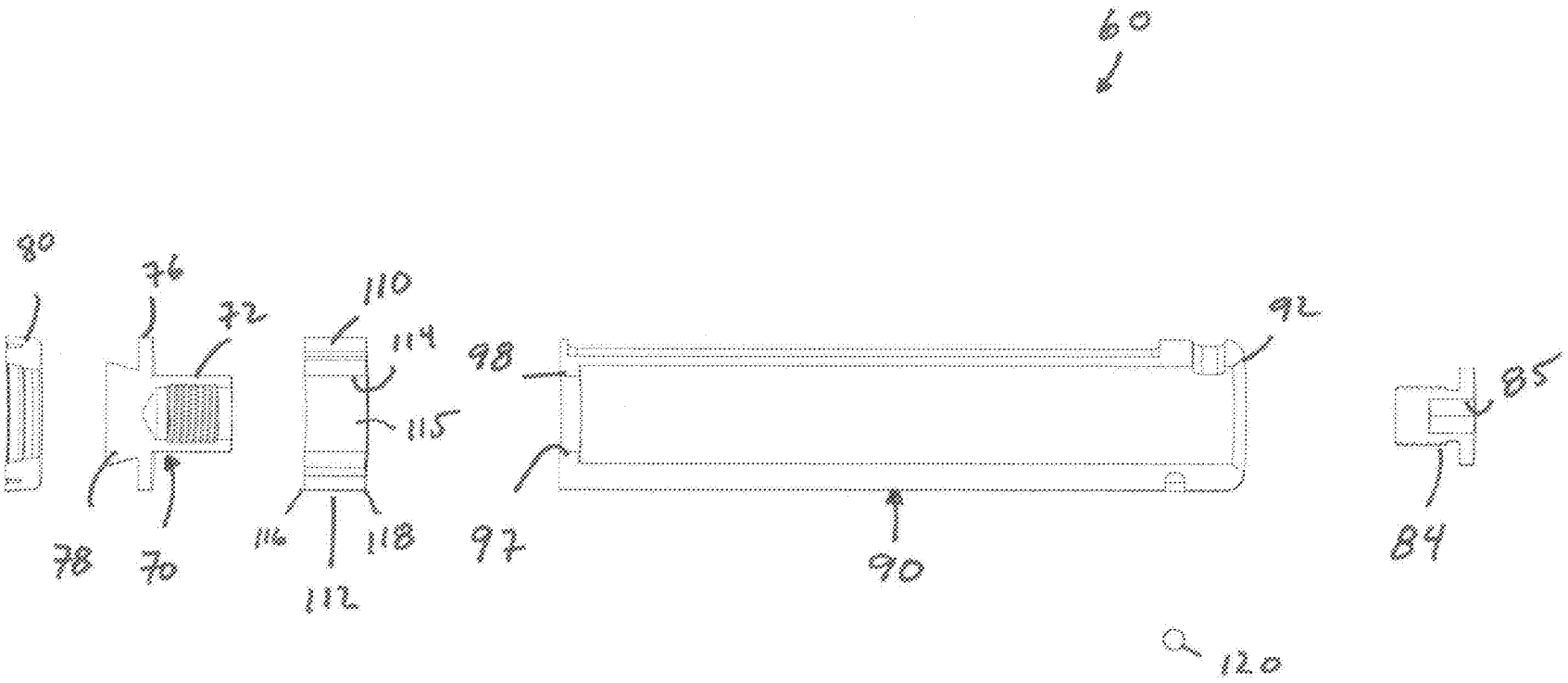
FIG. 4 is a side view cross section of the exploded compression piston of FIG. 3.
Figure 5:
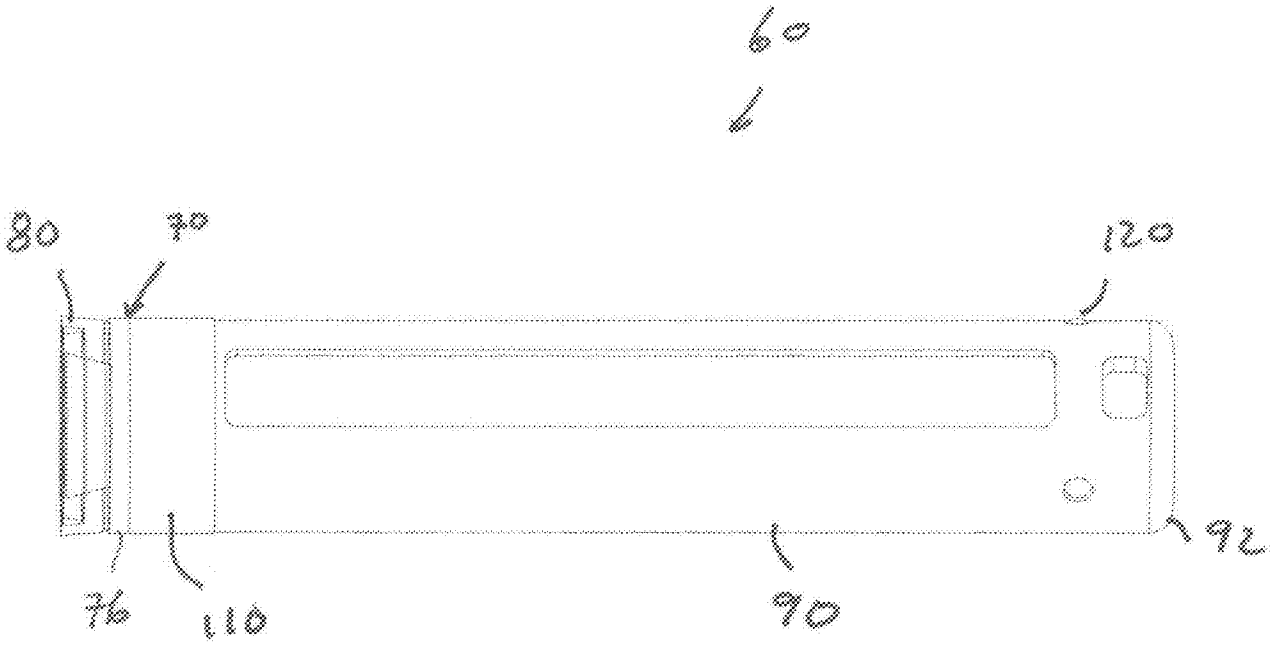
FIG. 5 is a side view of the assembled compression piston of FIG. 3.
Figure 6:
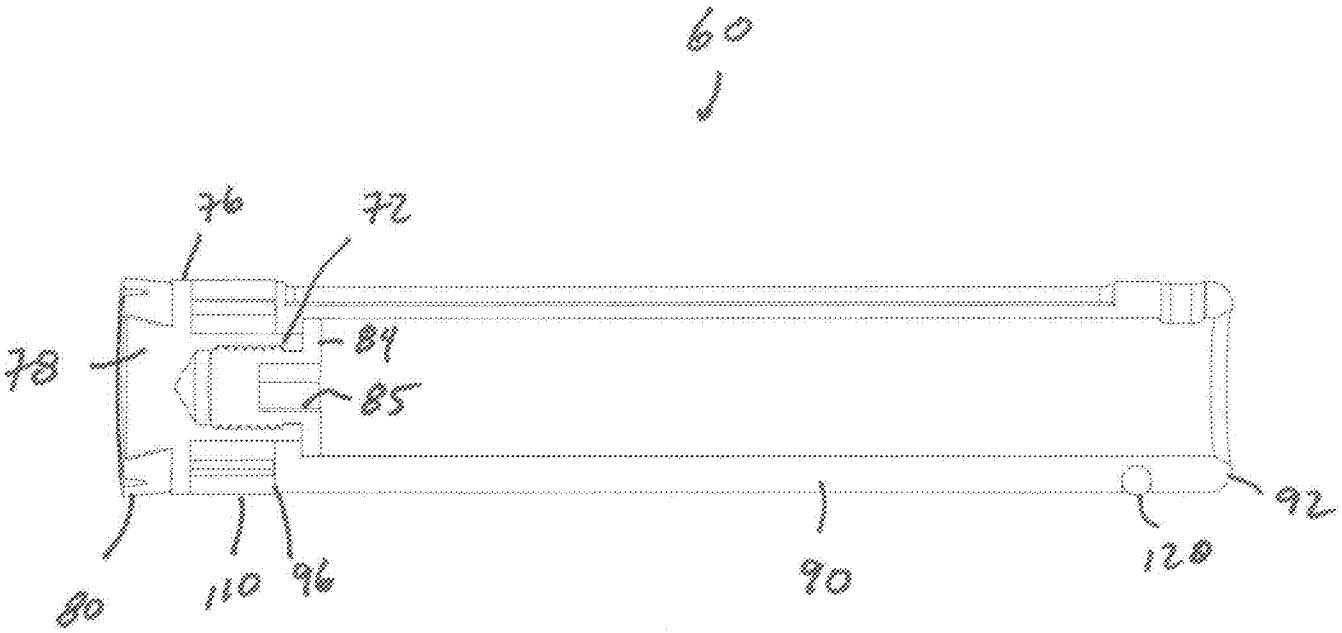
FIG. 6 is a side view cross section of the compression piston of FIG. 5.
Figure 7:
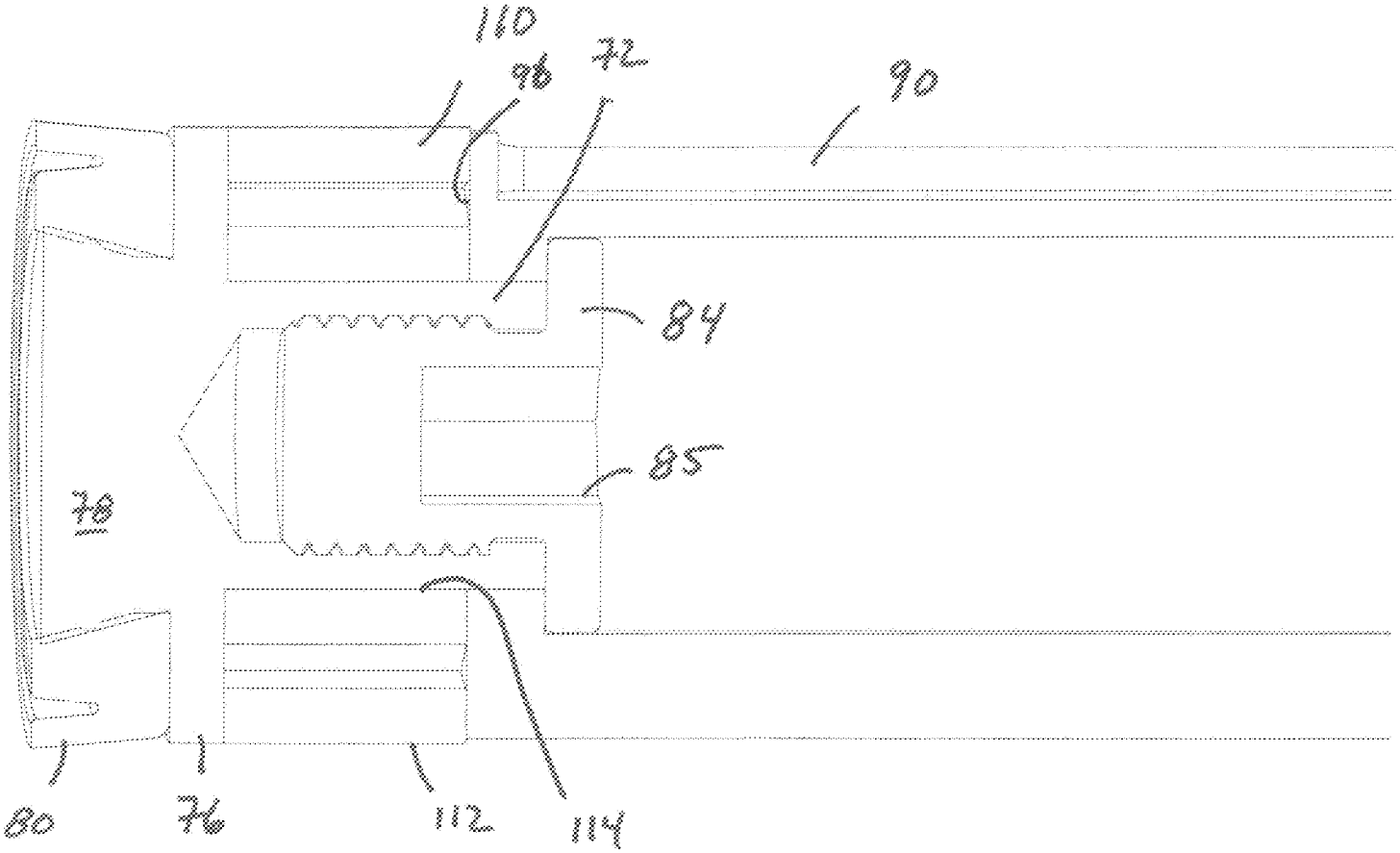
FIG. 7 is an enlarged side view cross section of the head of the compression piston of FIG. 5.
Figure 8:
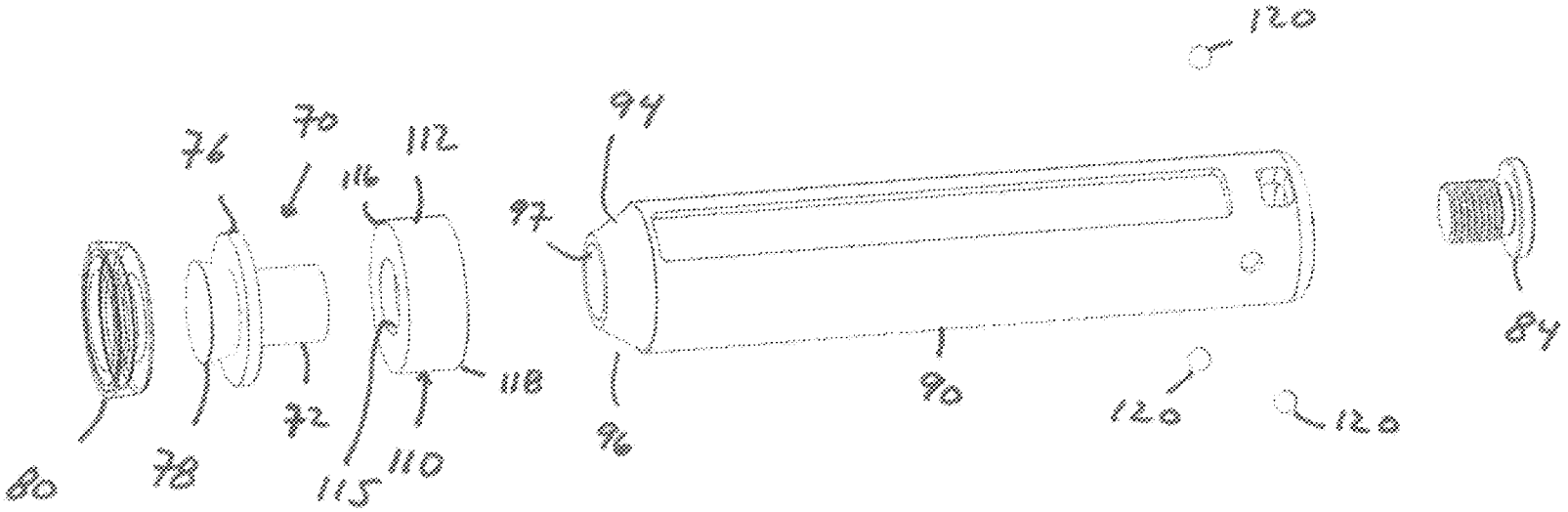
FIG. 8 is an exploded perspective view of a second configuration of the present compression piston.
Figure 9:
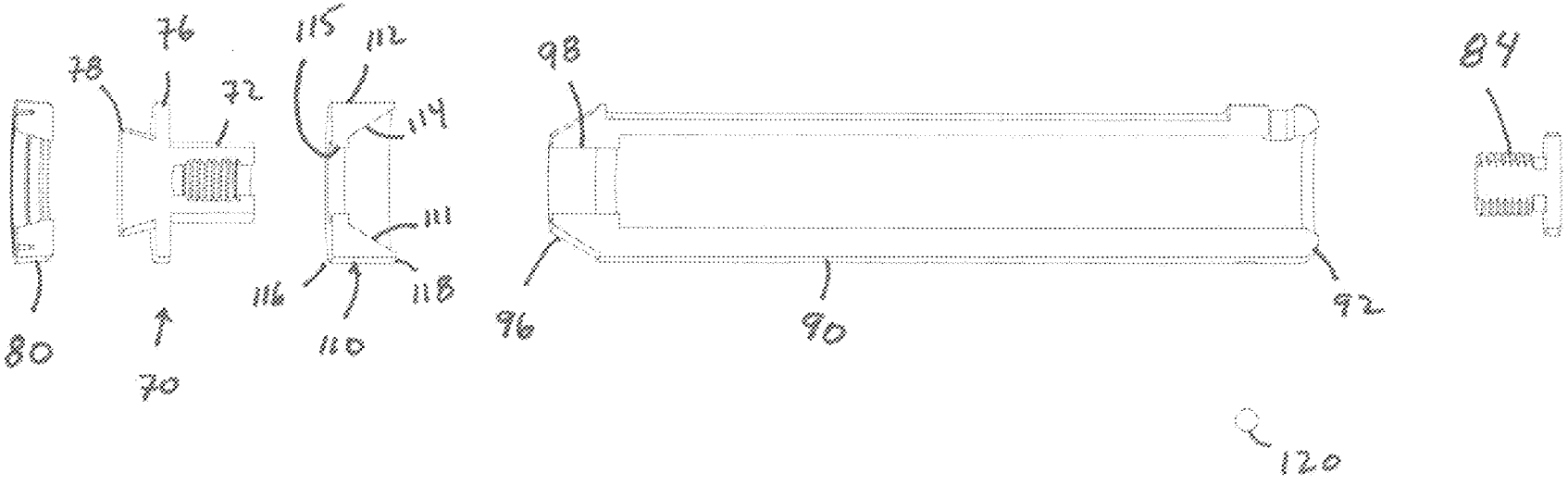
FIG. 9 is a side view cross section of the exploded compression piston of FIG. 8.
Figure 10:
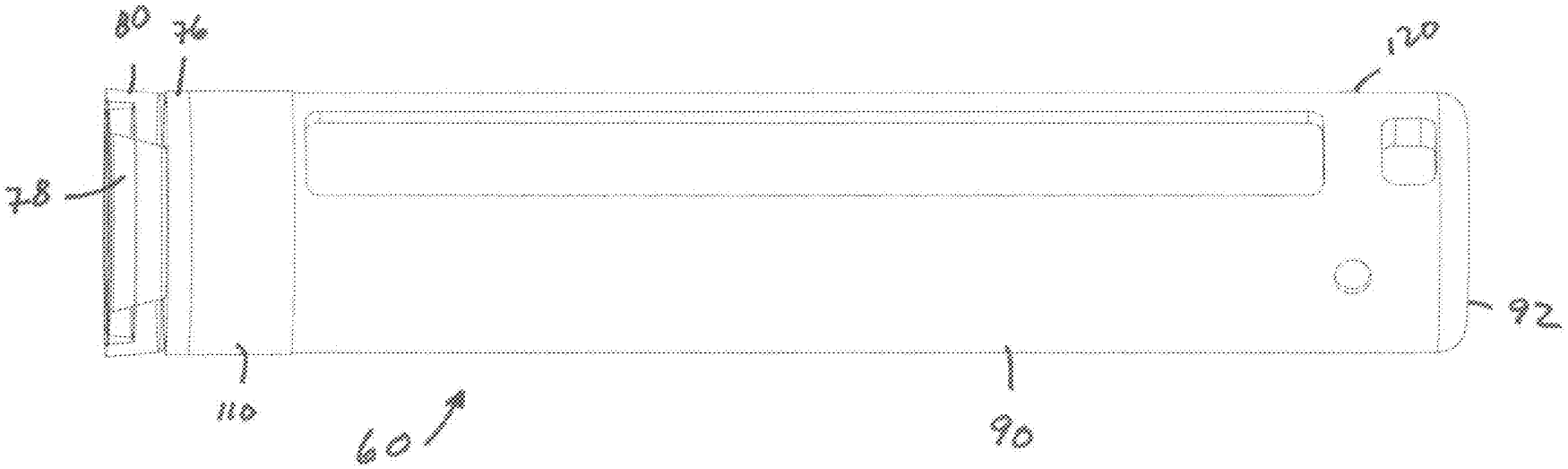
FIG. 10 is a side view of the assembled compression piston of FIG. 8.
Figure 11:
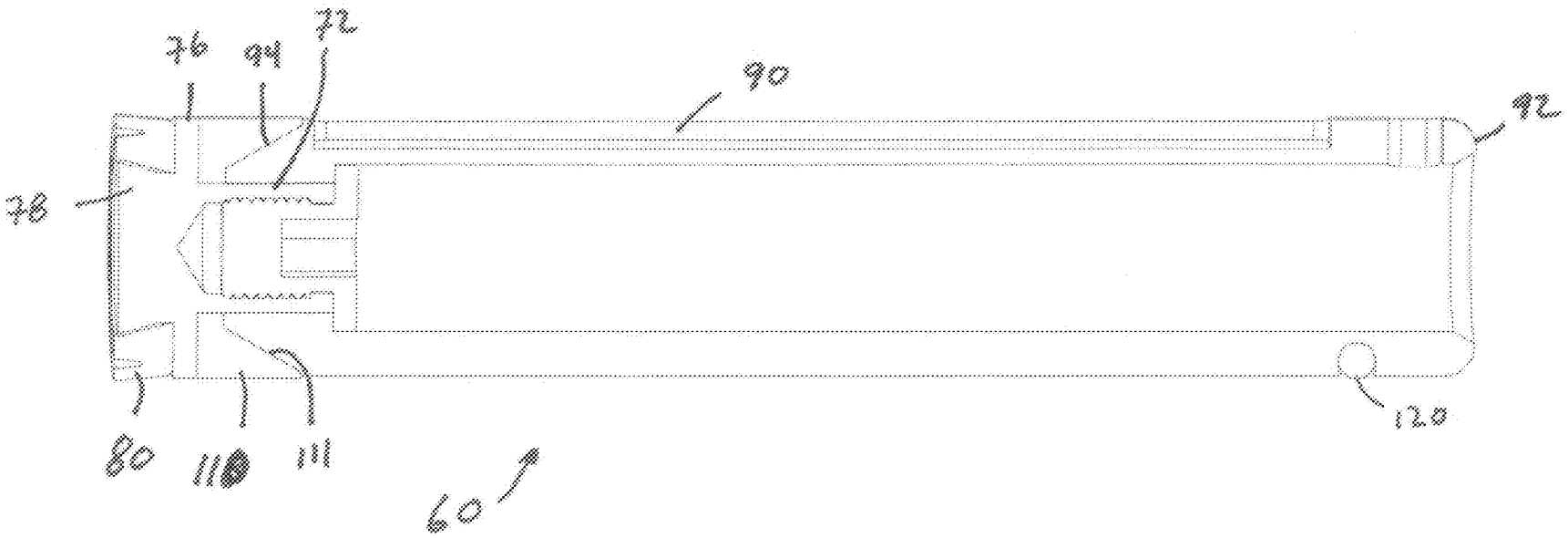
Figure 12:
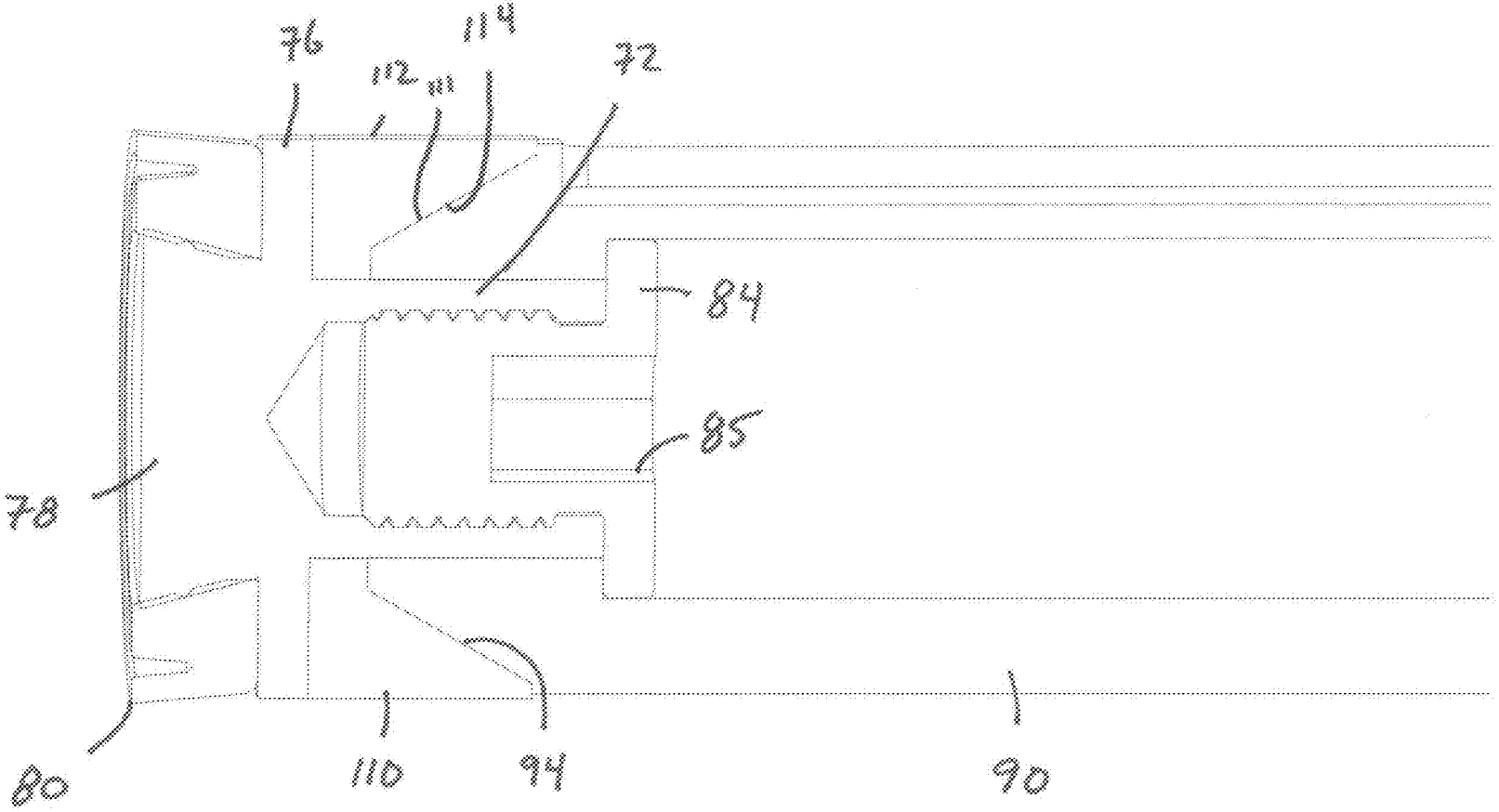
FIG. 12 is an enlarged side view cross section of the head of the compression piston of FIG. 11.

Referring to FIGS. 1 and 2, in the configuration used in the spring piston airgun 10, the airgun generally includes a barrel 12, a stock 16, a compression tube 22, a trigger mechanism 30, a cocking mechanism 40, a spring 50 and a compression piston 60

The barrel 12 is supported by the stock 16 and extends along a longitudinal axis from a breach to a muzzle. The breach is fluidly connected to a transfer port 24 of the compression tube 22. The compression tube 22 is well known in the art and is typically formed of a metal for performance, safety and durability factors. The compression tube 22 includes an inner or inside wall or surface 23.

The cocking mechanism can be any of a variety of mechanisms including but not limited to cams or levers, including cocking arms and break barrel constructions. The cocking mechanism allows the user to move the spring from a fired configuration, FIG. 1, to a cocked configuration, FIG. 2. Thus, energy is input into the airgun 10 for selective conversion into motion of the projectile through the barrel 12.

The compression piston 60 is moveable within the compression tube 22 to move between a cocked position and a fired position. Movement of the compression piston 60 from the cocked position to the fired position in response to the force of the spring 50 forces pressurized air through a transfer port to the breach to propel the projectile from the breach and through the barrel 12.

The spring 50 can be any of a variety of configurations including metal coil or helical springs, composite or alloy coil or helical springs as well as gas springs or struts. Each of these types of springs is well known in the industry. In one configuration, seen in FIGS. 1 and 2, the spring 50 is a longitudinal spring, that can be longitudinally compressed or extended but returns to a former configuration when released. In an alternative configuration, the spring 50 is a helical metal coil which expands and contracts generally along a longitudinal axis of the spring. Referring to FIGS. 1 and 2, the spring 50 is a gas spring having a gas spring body 52 defining a sealed interior chamber 54 containing a compressed gas 56 and a gas spring piston 58 extending into and moveable relative to the sealed interior chamber, the interior chamber retaining the compressed gas when the gas spring piston moves. Thus, as the gas spring piston 58 is forced into the sealed interior chamber 54 during cocking, the pressure in the internal chamber rises even further as the piston reduces the effective volume of the interior chamber. The increased pressure thus creates a force on the piston 58 urging the piston from the interior chamber 54.

As seen in FIGS. 3-12, the compression piston 60 is a multi-piece construction having a piston head 70, a piston body 90, and resilient, radially expanding, bushing 110, wherein the piston body is longitudinally displaceable relative to the piston head. For purposes of description, the piston head 70 is the portion of the compression piston 60 that is forward of the piston body 90. That is, the piston head 70 is nearer to the muzzle (or the transfer port 24) than the piston body 90.

Although the piston head 70 and piston body 90 could have numerous constructions, for purposes of the present description, the piston body is a generally cylindrical elongate member having a front or leading end 96 and a rear or trailing end 92. The piston body 90 includes an elongate channel 93 for accommodating the cocking mechanism 40, as known in the art.

The rear end 92 of the piston body 90 can be open and the front end 96 includes an aperture 97 defining a radially inward projecting shoulder 98.

The front end 96 can have any of a variety of profiles from flat faced (perpendicular to the longitudinal axis) as seen in FIGS. 3-7, to tapered, stepped or conical, as seen in FIGS. 8-12.

The compression piston 60, and in select configurations, the piston body 90 can include a plurality of tail guides 120. The tail guides 120 create multiple points of contact with compression tube 22, wherein these points of contact maintain the piston body 90, and hence compression piston 60, in a concentric orientation with the compression tube. The concentric orientation of the piston body 90 with the compression tube 22 increases efficiency of the compression piston 60 and reduces noise upon movement of the compression piston from the cocked to the fired position. Thus, the tail guides 120 can be located on the piston head 70, the piston body 90 or both the piston head and the piston body.

The multiple points of contact, in the configuration shown in FIGS. 3-12, can be three points. These three points are the minimum number of contacts required to keep the compression piston 60 concentric to the compression tube 22. Although the tail guides 120 can be located at a variety of circumferential positions, it has been found advantageous to symmetrically locate the tail guides about the 360 degree circumference of the piston body 90. Thus, the use of three tail guides 120 located at 120° intervals minimizes the frictional loses associated with tail guides, by reducing friction by keeping the rear end 92 of the piston body 90 and hence piston body isolated from contact with the compression tube 22. It is understood the location of the tail guides 120 is not specific per se. That is, the tail guides 120 can be located anywhere on the circumference of the piston body 90 and anywhere along the longitudinal dimension of the piston body 90.

As seen in FIGS. 3, 4, 6, 8, 9 and 11, the tail guides 120 can be generally spherical or hemispherical and are retained within corresponding recesses 123 in the piston body 90. However, the tail guides 120 are not limited to spheres or hemispheres, and can have faceted, apex, line or point contact surfaces with the compression tube 22, specifically an inner or inside surface or wall of the compression tube. It is also understood the number of tail guides 120 can range from one to a multiple such as 10 or more, depending on the desired operating characteristics and design construction.

Further, although the tail guides 120 are set forth as buttons, it is understood the tail guides could have any of a variety of configurations, including but not limited to arcs, ridges, helical sections, as well as lines either parallel to, inclined or perpendicular to the longitudinal axis.

Thus, it is the tail guides 120 that contact the compression tube 22 (specifically the inner wall 23 of the compression tube), rather than the material of the piston body 90 contacting the compression tube. The use of the tail guides 120 rather than a ring or sleeve extending about the compression piston 60, further reduces the frictional losses by reducing the total contact area between the compression piston (the piston body 90) and the compression tube 22, while keeping the compression piston stable, and off the compression tube wall 23.

The tail guides 120 not only reduce friction during the firing cycle, but the tail guides reduce the metal to metal contact between the compression tube 22 and the compression piston 60, thereby further reducing and damping vibration. A further benefit lies in the cocking of the compression piston 60, as the tail guides 120 contribute to smoother movement of the compression piston relative to the compression tube 22 during cocking of the air gun.

The tail guides 120 can be formed of a variety of materials, including but not limited to polymers such as nylon, PTFE and PTFE coated nylon. While numerous configurations of the tail guides 120 are non-metal, it is understood various alloys and metals, such as oil impregnated bronze can be used for the tail guides.

Referring to FIGS. 3, 4, 6-9, 11 and 12, the piston head 70 includes a rearwardly projecting stem 72, a radially projecting flange 76 and a seal retainer 78. The stem 72 has a diameter sized to slidingly pass through the aperture 97 in the front end 96 of the piston body 90. The stem 72 has an axial (longitudinal) dimension sufficient to engage the bushing 110, as set forth below. The flange 76 is sized to preclude passage of the piston head 70 through the aperture 97.

The piston head 70 carries a piston seal 80 for forming a sliding sealed interface with the inside surface of the compression tube 22. The piston seal 80 is well known in the art in both material and structure. Similarly, the engagement of the piston seal 80 to the piston head 70 can be provided as known in the art, such as by seal retainer 78 which is in the form of a flared or tapered surface selected to engage a corresponding surface on the seal 80.

A capture piece 84 such as a bolt (or nut) is sized to pass through the rear end 92 of the piston body 90 and engage the piston head 70, such as by engaging the stem 72. The capture piece 84 includes a portion having a radial dimension precluding passage through the aperture 97. Although the capture piece 84 is shown as a bolt having external threads for engaging corresponding internal threads on the stem 72 of the piston head 70, it is understood that any of a variety of interconnect structures can be used to retain the piston head 70 to the piston body 90. That is, the stem 72 can include external threads with the capture piece 84 can be a nut having internal threads for engaging the stem. Alternatively, rotatable bayonet type interlocks can be used. Similarly, snap or detent connections can be employed to retain the piston head 70 relative to the piston body 90. It has been found advantageous for the piston head 70 to be able to rotate relative to the piston body 90. Thus, while the capture piece 84 can locate and retain the piston head 70 at a fixed rotational position with the piston body, in select configurations, the piston head can rotate relative to the piston body.

Referring to FIGS. 6, 7, 11 and 12, the capture piece 84 can include a recess 85 for cooperatively receiving a tool such as a hex key, a screw driver or even socket driver for providing adjustment of the longitudinal spacing for the bushing 110. That is, the longitudinal spacing between the portion of the piston head 70 and the portion of the piston body 90 receiving the bushing 110 can be set to be greater than, equal to or less than the corresponding longitudinal dimension of the bushing. Thus, by selectively setting, or preloading, a compressive force on the bushing 110, the reaction of the bushing (amount of radial expansion) can be set for a given compression piston 60 and airgun 10 or system.

As seen in FIGS. 3-15, the bushing 110 is captured between a portion of the piston head 70 and a portion of the piston body 90. In one configuration, the bushing 110 is retained between the front end 96 of the piston body 90 and the flange 76 of the piston head 70.

The bushing 110 has an outer wall 112, an inner wall 114 defining a central aperture 115 sized to receive the stem 72 of the piston head 70, a front end 116 and a rear end 118. The outer wall 112 can be a generally cylindrical surface. However, it is understood the outer wall 112 can be non-cylindrical and include ridges or protuberances. In addition the outer wall can be tapered such as frustoconical, wherein the largest diameter is equal to or less than the diameter of the compression tube 22.

The front end 96 of the piston body 90 and the rear end 118 of the bushing 110 can be substantially planar (perpendicular to the longitudinal axis), inclined such as wedged or tapered as well as featured such as ridges or protuberances. Thus, the bushing 110 and the piston body 90 can define engaging surfaces, wherein the engaging surfaces are non-perpendicular to the longitudinal axis. The engaging surfaces can be selected to enhance radial expansion of the bushing 110 during deceleration of the compression piston 60 during the firing cycle.

The bushing 110 can be solid, hollow, webbed, non-homogenous (i.e. multiple bodies/materials as in over molded, or even liquid filled) and any combination thereof. Thus, the bushing 110 can have portions of greater and lesser density. The multiple material configuration allows a portion of the bushing 110 designed for contacting the compression tube 22 to be made of a complimentary non degrading material, while a supporting portion of the bushing is made of a less expensive material. Similarly, the materials can be chosen for performance such as an underlying portion of the bushing 110 being relatively resilient—deformable, while the surface coating provides a lubricious interface with the compression tube 22.

The bushing 110 can be formed from a variety of materials which provide the necessary radial expansion upon axial compression, along with the necessary wear characteristics and resilience. Further, the bushing 110 is sufficiently resilient to functionally return to an uncompressed (un-radially expanded) configuration upon the removal of a longitudinal compressive force between the piston head 70 and the piston body 90. The bushing 110 can be a polymer material including but not limited to nylon or PTFE coated polymers including nylon. A representative material for the bushing 110 is a polymer, such as but not limited to polyurethane. The specific material of the bushing, polymeric or metal, is determined by the intended operating parameters of the compression piston 60 and airgun 10. Thus, the bushing 110 can be non-metal.

The relative size and/or weight between the piston body 90 and the piston head 70 can be selected to be between approximately 1:20 to 20:1. That is, depending on the intended operating characteristics, materials and design parameters, the piston body 90 can be 95% of the length of the compression piston 60 and the piston head 70 can be 5% of the length of the compression piston 60. Conversely, the piston body 90 can be 5% of the length of the compression piston 60 and the piston head 70 can be 95% of the length of the compression piston 60.

Alternatively, it is contemplated the ratio of the weight (or mass) of the piston body 90 to the piston head 70 can be selected to be any of a variety of ratio from approximately 20:1 to 1:1 to 1:20, depending on the intended operating characteristics, materials and design parameters.

Similarly, depending on the intended operating characteristics, materials and design parameters, the bushing 110 can be approximately 1% of the length to approximately 95% of the length of the compression piston 60. Further, again depending on depending on the intended operating characteristics, materials and design parameters, the weight (or mass) of the bushing 110 can be selected to range from approximately 1% to 95% of the weight (or mass) of the compression piston 60.

The spring 50 can contact or engage the compression piston 60 at any of a variety of locations. For example, the spring 50 may contact piston head 70 directly, the capture piece 84, such as the capture nut or bolt, the bushing 110, the piston body 90, or any combination thereof.

The orientation of the spring 50, such as a gas spring, is independent of the compression piston 60. That is, the gas spring piston 58 of the gas spring or the gas spring body 52 of the gas spring can contact the compression piston 60 for selectively moving the compression piston between the first and the second positions, such as from the cocked position to the fired position.

The interaction of the compression piston 60 and the compression tube 22 during firing of the airgun 10 is selected to reduce recoil/vibration, increase efficiency of the airgun using a spring to move the compression piston (contacting the gas spring) relative to a compression tube.

Figure 13:
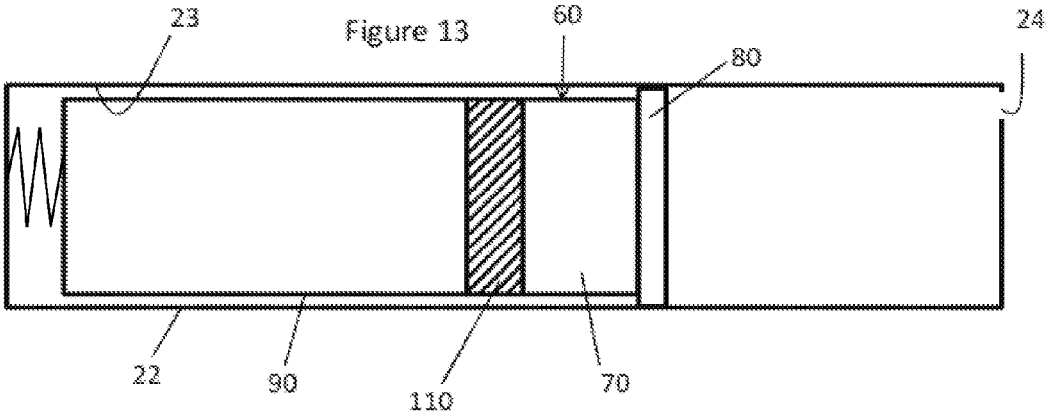
FIG. 13 is a schematic representation of the compression piston relative to the compression tube during an early portion of the firing cycle.
Figure 14:
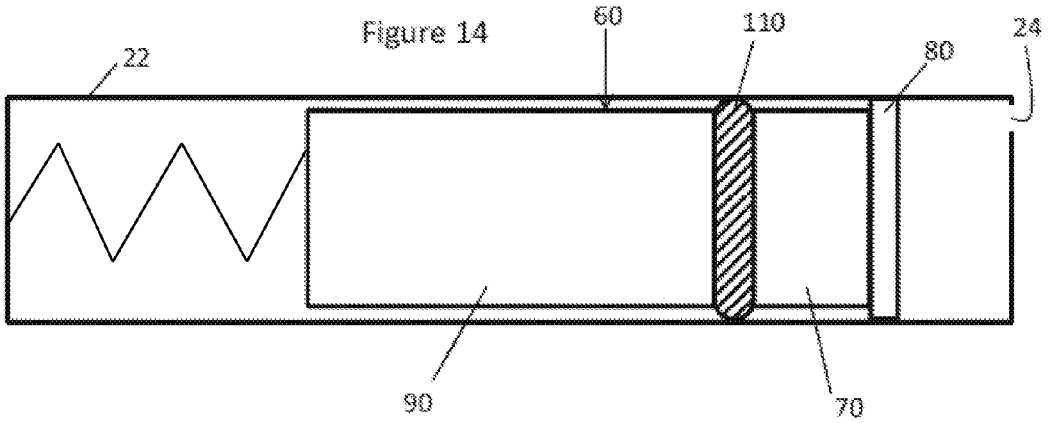
FIG. 14 is a schematic representation of the compression piston relative to the compression tube during an intermediate portion of the firing cycle.
Figure 15:
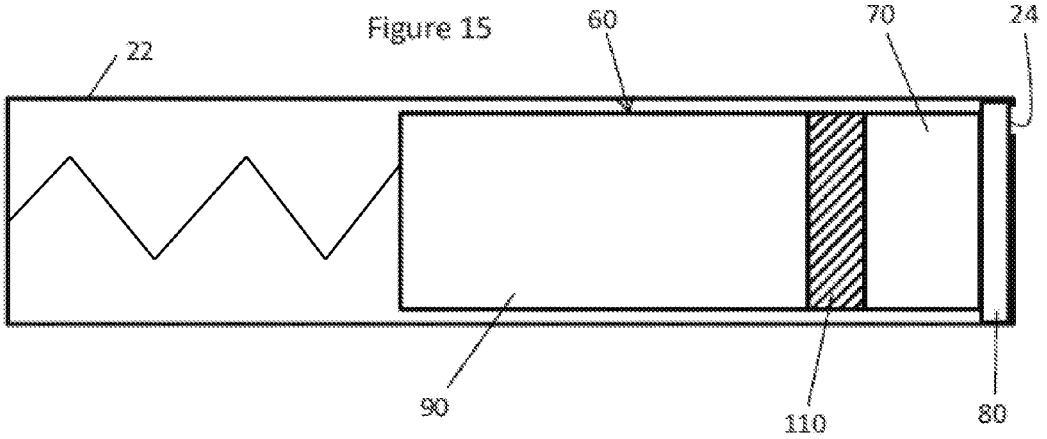
FIG. 15 is a schematic representation of the compression piston relative to the compression tube at the terminal portion of the firing cycle.

As set forth above and referring to FIGS. 13-15, the spring 50 causes the compression piston 60 to move from the cocked position to the fired position within the compression tube 22. As the compression piston 60 moves from the cocked position to the fired position under bias from the spring 50, air in front of the piston head 70 (and seal 80) compresses in the compression tube 22 and the pressure rises. As the pressure ahead of the piston head 70 in the compression tube 22 rises, the piston head begins to decelerate. The inertia of the piston body 90 continues forward toward the transfer port 24. The deceleration of the piston head 70 and the inertia of the piston body 90 changes the relative longitudinal spacing of the piston head and the piston body and simultaneously longitudinally compresses the bushing 110 while still driving the compression piston 60 toward the end of the compression tube 22 toward the transfer port 24, forcing the high pressure air through the transfer port (and into the barrel 12 of the airgun 10). The longitudinal compression of the bushing 110 forces the bushing outward (radially expands) to contact the inner wall or surface 23 of the compression tube 22, thereby acting as a braking system. The slightly longer deceleration time of the piston head 70, as the piston body 90 compresses the bushing 110, allows more air to flow through the transfer port 24 (into the barrel 12) so as to add energy to the projectile, and the energy is no longer available to contribute to reversal of the direction of travel of the compression piston 60 within the compression tube. As pressure continues to rise in the compression tube 22 ahead of the piston head 70 and the piston head slows to a stop, the bushing 110 is at full compression and exerting its maximum force into the compression tube, the engagement of the bushing and the compression tube resists backwards travel of the compression piston 60 and piston head 70. This reduction in backward travel of the compression piston 60 including the piston head 70 keeps the volume between the front of the piston head (the seal 80) and the front end of the compression tube 22 (volume to the transfer port 24) low, thus maintaining higher compression tube pressure for a longer period of time, allowing an additional amount of energy to be added to the projectile.

The removal of the longitudinal compression on the bushing 110 allows the bushing to return to the uncompressed state and the longitudinal spacing of the piston head 70 and piston body 90 returns to the non firing state.

The amount of radial expansion of the bushing 110 can be influenced by the profile of the contacting surfaces of the bushing 110 and the piston body 90. For example, referring to FIGS. 8, 9, 11 and 12, the front end 96 of the piston body 90 includes a taper or wedge surface 94 and the corresponding surface of the bushing 110, such as the rear end 118 or inner wall 114 includes a taper 111. Thus, upon the piston head 70 decelerating first and the longitudinal distance between the piston body 90 and the piston head reducing, the contacting inclined surfaces of the piston body and the bushing 110 tend to splay the bushing against the compression tube 22, thereby resisting rearward motion of the compression piston 60 and increasing the mass to compressed air passed through the transfer port 24 to the barrel 12.

The action within the components of the compression piston 60 and interaction with the compression tube 22 during movement of the compression piston from the cocked to the fired position also reduces system vibration and recoil (1) by decreasing the rate of deceleration (jerk) (2) by isolating the forward metallic portion of the piston body 90 from contacting the wall 23 of the compression tube 22, and (3) by damping the oscillation of bounce back of the compression piston.

Thus, in one configuration, the piston body 90 is moveable relative to the piston head 70 along the longitudinal axis to the extent the bushing 110 is compressible along the longitudinal axis. However, it is understood that as the longitudinal spacing for receiving the bushing 110 can be adjusted, the amount of longitudinal displacement of the piston head 70 relative to the piston body 90 can be greater, equal to or less than the amount of longitudinal compression of the bushing under operating parameters.

Thus, the present disclosure provides a method of using the spring 50 to urge the compression piston 60 to move within the compression tube 22 towards a muzzle end of the compression tube, the compression piston including the piston head 70 and the piston body 90, the piston head being longitudinally displaceable relative to the piston body; and radially expanding the bushing 110 intermediate the piston head and the piston body a sufficient radius to decelerate at least a portion of the compression piston relative to the compression tube. The sufficient radius can be sufficient to contact the bushing 110 with the inner surface of the compression tube. It is further contemplated the spring 50 can be a coil spring or a gas spring. The gas spring can includes the gas spring body 52 defining the sealed interior chamber 54 containing the compressed gas and the gas spring piston 58 extending into and moveable relative to the sealed interior chamber, the interior chamber retaining the compressed gas when the gas spring piston moves.

Further, the method includes disposing the radially expandable bushing 110 on the compression piston 60, wherein the compression piston has a piston head 70 including the piston seal 80 and the piston body 90, and the bushing is intermediate the piston head and the piston body, the bushing expanding a sufficient radius to contact an inner surface of the compression tube 22 of an airgun 10 in response to longitudinal displacement of the piston head relative to the piston body; locating the compression piston 60 and the bushing 110 at least partially within the compression tube of the airgun; and mounting the spring 50 in the airgun to urge the compression piston to move within the compression tube towards a barrel or muzzle end of the compression tube.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed is:

1. An airgun comprising:

(a) a barrel;

(b) a compression tube having transfer port fluidly connected to the barrel;

(c) a compression piston at partially disposed within the compression tube and moveable within the compression tube between a first position and a second position, the compression piston having a piston body and a piston head, the piston head being longitudinally displaceable relative to the piston body during movement from the first position to the second position;

(d) a seal connected to the piston head and forming a sealed interface with an inside surface of the compression tube;

(e) a spring contacting the compression piston, the spring repeatably moveable between a cocked position and a fired position, wherein the compression piston is in the first position in the cocked position of the spring and the compression piston is in the second position in the fired position of the spring; and (f) a radially expandable bushing connected to the piston body, the bushing radially expanding from a non contacting configuration to a contacting configuration in response to a longitudinal compressive force on the bushing, the longitudinal compressive force corresponding to movement of the spring from the cocked position to the fired position and the radial expansion of the bushing in the contacting configuration sufficient to contact the inside surface of the compression tube.

2. The airgun of claim 1, further comprising a plurality of tail guides extending radially from the compression piston, the plurality of tail guides contacting an inside surface of the compression tube.

3. The airgun of claim 1, wherein the spring is a gas spring having a gas spring body defining a sealed interior chamber containing a compressed gas and a gas spring piston extending into and moveable relative to the sealed interior chamber, the interior chamber retaining the compressed gas when the gas spring piston moves.

4. The airgun of claim 1, wherein the bushing and the piston body define engaging surfaces, and the surfaces are non-perpendicular to the longitudinal axis.

5. An airgun comprising:

(a) a compression tube;

(b) a compression piston slideably received within the compression tube, the compression piston having a piston body and a piston head, the compression piston moveable between a cocked position and a fired position, the piston head moveably connected to the piston body to be longitudinally displaceable relative to the piston body between a first distance in the cocked position and a shorter second distance in the fired position, the piston head including a seal, the seal forming a sealed interface with an inside surface of the compression tube; and (c) a radially expandable bushing contacting the piston head and the piston body, the bushing radially expanding in response to relative longitudinal movement of the piston body towards the piston head, the bushing having a first configuration defining a first radius in the cocked position of the compression piston and a second configuration defining a greater second radius in the fired position of the compression piston, the first radius sized to preclude contact with the inside surface of the compression tube and the second radius sized to contact the inside surface of the compression tube.

6. The airgun of claim 5, wherein one of the piston head and the piston body include a plurality of radially projecting tail guides.

7. The airgun of claim 6, wherein the plurality of radially projecting tail guides locate a portion of the piston body relative to an inner surface of a compression tube.

8. The airgun of claim 5, wherein the piston body has a greater weight than the piston head.

9. The airgun of claim 5, wherein the seal is selected to provide a sealing interface with an adjacent compression tube.

10. The airgun of claim 5, further comprising a spring contacting one of the piston body, the piston head and the bushing.

11. The airgun of claim 5, wherein the spring is a gas spring having a gas spring body defining a sealed interior chamber containing a compressed gas and a gas spring piston extending into and moveable relative to the sealed interior chamber, the interior chamber retaining the compressed gas when the gas spring piston moves.

12. A method comprising:

(a) disposing a radially expandable bushing on a compression piston, the compression piston sized to be slideably disposed within a compression tube of an airgun between a cocked position and a fired position, the compression piston having (i) a piston head including a piston seal and (ii) a piston body, wherein the bushing is intermediate the piston head and the piston body, the bushing expanding from a first radius in the cocked position, the first radius sized to preclude contact with an inside surface of the compression tube to a greater second radius in the fired position, the second radius sized to contact the inner surface of the compression tube of the airgun in response to longitudinal displacement of the piston head relative to the piston body;

(b) locating the compression piston and the bushing at least partially within the compression tube of the airgun; and (c) mounting a spring in the airgun to urge the compression piston to move within the compression tube from the cocked position to the fired position.

13. The method of claim 12, wherein the spring is a coil spring.

14. The method of claim 12, wherein the spring is a gas spring.

15. The method claim 14, wherein the gas spring includes a gas spring body defining a sealed interior chamber containing a compressed gas and a gas spring piston extending into and moveable relative to the sealed interior chamber, the interior chamber retaining the compressed gas when the gas spring piston moves.

* * * * *